United States Patent [19]

Larson et al.

[11] Patent Number: 5,016,559

[45] Date of Patent: May 21, 1991

[54] BOOKMARK HAVING INTEGRAL PENCIL HOLDER

[75] Inventors: Vada J. Larson; Roger L. Larson, both of 8675 Scandia Rd., Waconia, Mich. 55387; Walter I. Bieger, St. Paul, Minn.

[73] Assignees: Vada J. Larson; Roger L. Larson, both of Waconia, Mich.

[21] Appl. No.: 374,464

[22] Filed: Jun. 30, 1989

[51] Int. Cl.[5] ..... B42D 9/00

[52] U.S. Cl. ..... 116/234; 24/11 R; 24/555; 24/562

[58] Field of Search ..... 116/234–240; 281/42; D19/34; 24/10 R–11 P, 545, 555, 561–563; 40/352, 666

[56] References Cited

U.S. PATENT DOCUMENTS

| | | | |
|---|---|---|---|
| 155,196 | 9/1874 | McNair | 281/42 |
| 637,889 | 11/1899 | Parker et al. | 281/30 |
| 803,464 | 10/1905 | Beck | 24/339 |
| 884,256 | 4/1908 | Addie | 24/11 PP |
| 1,392,119 | 9/1921 | Corbin et al. | 24/555 |
| 2,300,216 | 10/1942 | Grodsky et al. | 116/237 |
| 2,344,613 | 3/1944 | Hellstern | 116/237 |
| 2,670,221 | 2/1954 | Wellendorf | 40/352 |
| 3,513,806 | 5/1970 | Ferrick | 116/237 |

FOREIGN PATENT DOCUMENTS 24895 of 1910 United Kingdom .

*Primary Examiner*—William A. Cuchlinski, Jr.
*Assistant Examiner*—W. Morris Worth
*Attorney, Agent, or Firm*—Dorsey & Whitney

[57] ABSTRACT

The combination bookmark and writing instrument holder includes a generally planar marking strip and an integrally molded retaining clip at one end of the marking strip. In the preferred embodiment, the retaining clip includes a pair of generally symmetrical, outwardly jaws that together present a writing instrument retaining channel. The channel includes a writing instrument retaining portion, and an outwardly flared mouth portion for guiding the writing instrument into the retaining portion.

5 Claims, 3 Drawing Sheets

152
150
160
156
162
164
158
166
172
154
178
176
170
174
216
224
230
204
226
220
222
228
232

202
210
214
206
200
212
208

234
236
238
240

BOOKMARK HAVING INTEGRAL PENCIL HOLDER

TECHNICAL FIELD

This invention relates to an improved marker for use with a book, magazine, or other printed material to indicate the reader's place in the material. In particular, it relates to a bookmark having an integral mechanism for removably retaining a pen or pencil at the uppermost portion of the marker.

BACKGROUND ART

Page holders and bookmarks designed to retain a pen or pencil are known. For instance, U.S. Pat. No. 2,300,216 discloses a bookmark having a closed loop at one end designed to slidably retain a writing instrument. Other patents disclosing page markers with some means for retaining a pen or pencil thereon include U.S. Pat. Nos. 803,464, 2,344,613, and 3,513,806. Previous bookmark designs, however, have not been designed to taken advantage of the structural characteristics of synthetic resins, and have not been readily adaptable to accommodate writing instruments of various diameters.

A bookmark having an integral writing instrument holder, that is specifically designed to take advantage of the characteristics of synthetic resin materials, and that is readily adaptable to accommodate writing instruments of different diameters, would be a decided advantage.

SUMMARY OF THE INVENTION

The bookmark in accordance with the present invention includes an elongated, generally planar marking strip having an integrally molded, resilient clip member at one end thereof. The clip member comprises a pair of generally symmetrical, outwardly flared jaws that together present a neck portion adjacent the marker strip, a writing instrument retaining midportion, and a outwardly flared mouth portion for guiding the writing instrument into the retaining portion.

DETAILED DESCRIPTION OF THE DRAWINGS

Figure 2:
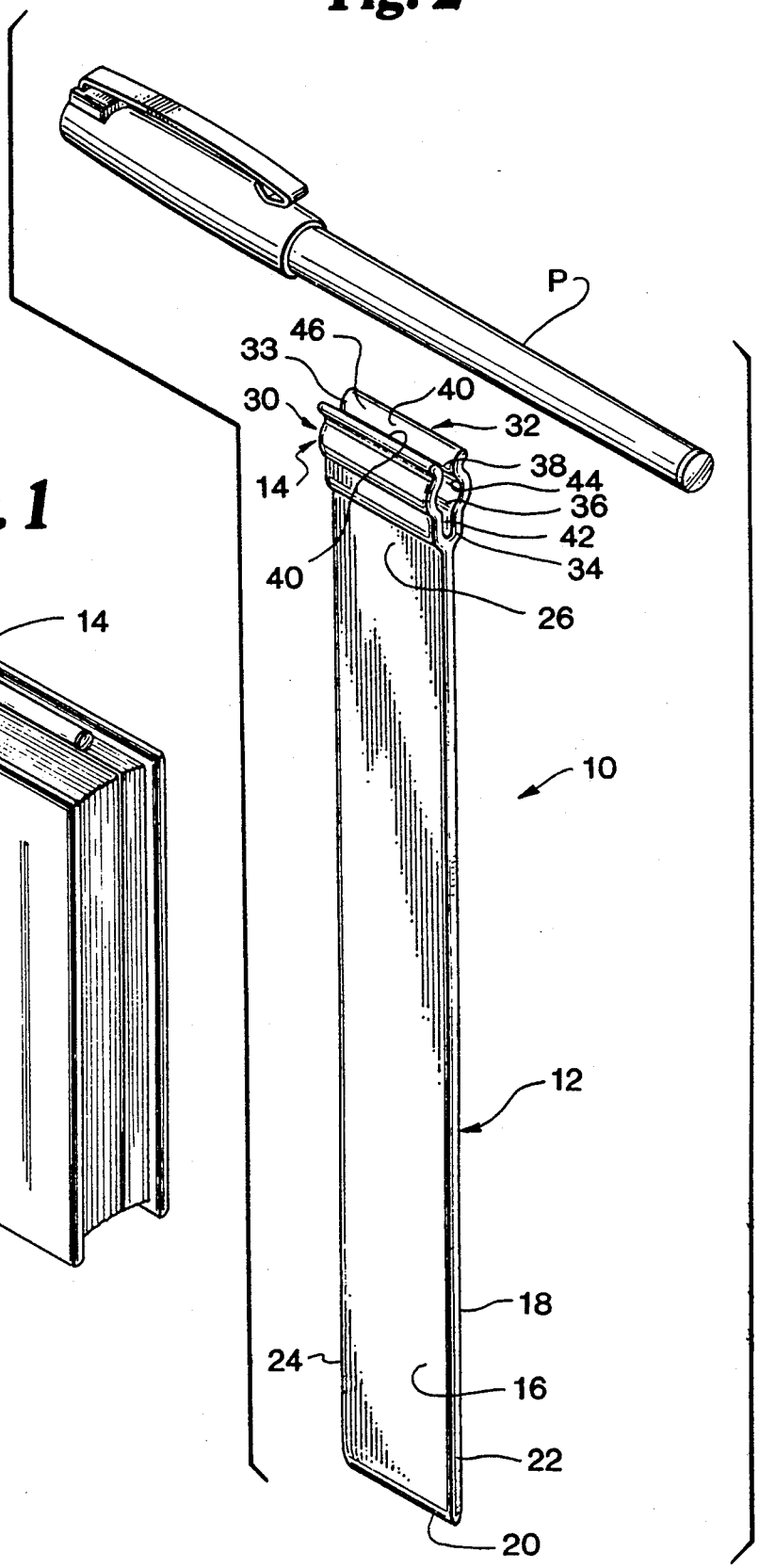
FIG. 2 is a perspective view of a bookmark in accordance with the present invention and a pen positioned to be received by the clip member of the bookmark.

Referring to the drawings, a bookmark 10 in accordance with the present invention broadly includes generally planar marking strip 12, and resilient clip member 14 integrally molded with the marking strip 12. The marking strip 12 and clip member 14 are preferably molded from a flexible, resilient, synthetic resin material.

Figure 1:
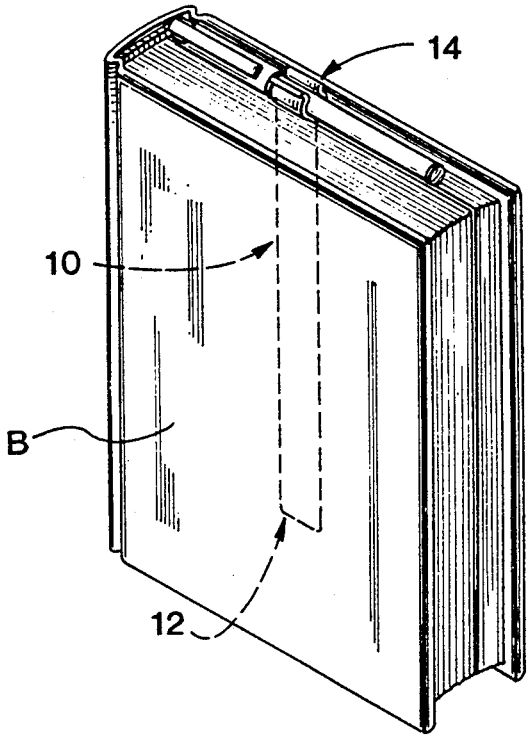
FIG. 1 is a perspective drawing of a book having a bookmark in accordance with the present invention received therein.

The marking strip 12 includes opposed front and rear faces 16, 18, lower margin 20, opposed side margin 22, 24, and upper portion 26. The lower margin 20, as best seen in FIG. 2, preferably presents a generally rounded surface. Referring to FIG. 1, the marking strip 12 is preferably about 6 inches in length, and about an inch to an inch and one-half in width such that the marking strip 12 is supportably retained within a book B when inserted between the pages of the book. When constructed from a clear synthetic resin, the strip 12 can be formed to act as a magnifying glass.

Clip member 14 is integrally molded with the marking strip 12 at the marking strip's upper portion 26. The clip member 14 comprises a pair of outwardly flared jaws 30, 32. The jaws 30, 32 together present a retaining channel 33 having a generally U-shaped neck portion 34, a writing instrument engaging midportion 36, and an outwardly flared mouth portion 38. As is best seen in FIG. 2, the inner surface 40 of each jaw 30, 32 presents a generally planar sidewall section 42 at the neck portion 34 of the clip member 14, a generally concave sidewall section 44 at the midportion 36 of the clip member 14, and a generally convex sidewall section 46 at the mouth portion 38 of the clip member 14.

Figure 3:
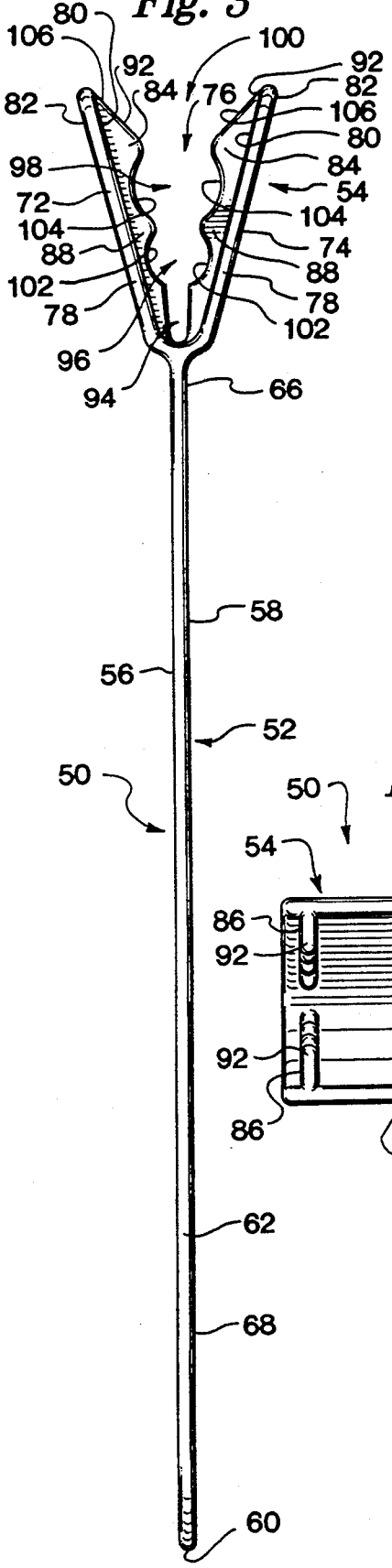
FIG. 3 is a side elevational view of a second embodiment of the bookmark in accordance with the present invention.
Figure 5:
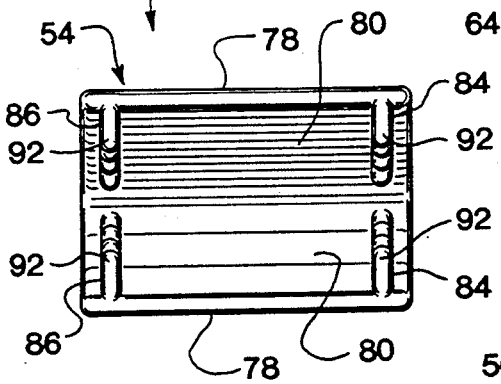
FIG. 5 is a top plan view of the bookmark depicted in FIG. 3.
Figure 4:
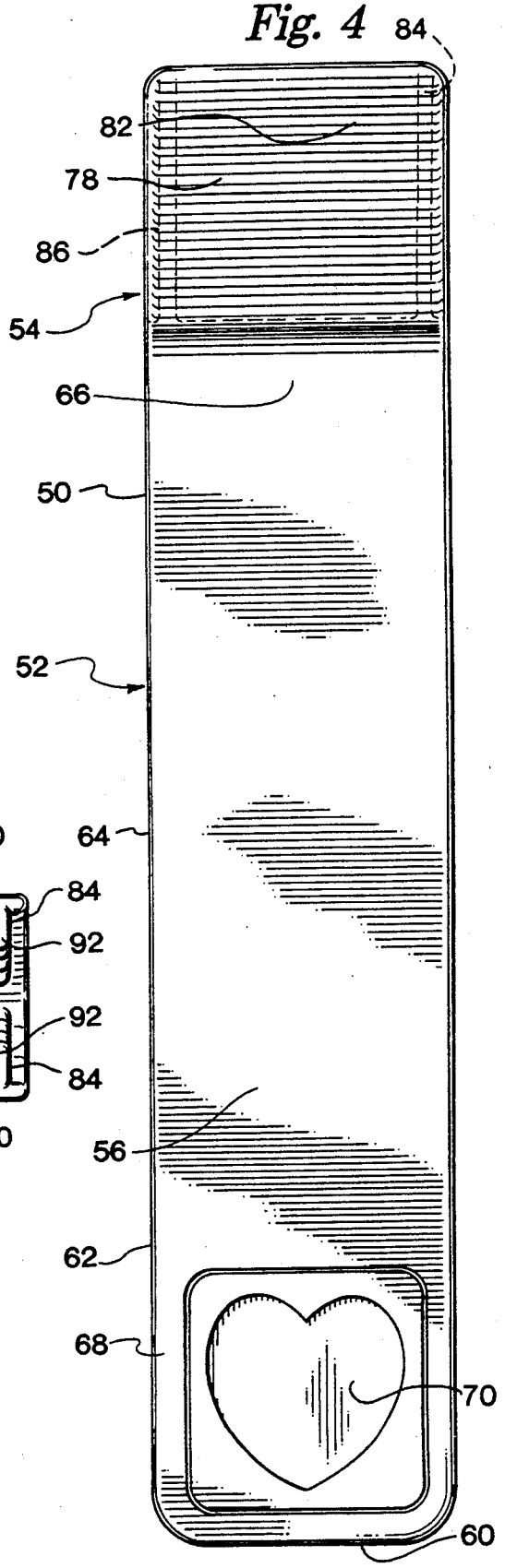
FIG. 4 is a front elevational view of the book mark depicted in FIG. 3.

A second embodiment of a bookmark 50 in accordance with the present invention is depicted in FIGS. 3–5. The bookmark 50 broadly includes a marking strip 52 and a clip member 54 integrally molded with the marking strip 52. The marking strip 52 is similar in construction to the marking strip 12 described in conjunction with the first embodiment, having front and rear faces 56, 58, lower margin 60, opposed side margins 62, 64, and upper portion 66. The lower portion 68 of the marking strip 52 includes cutout portion 70 in the shape of a heart. Those skilled in the art will appreciate that a variety of cutout shapes can be molded into the lower portion, or in any other portion of the marking strip 52, by providing different shaped inserts into the mold from which the synthetic resin bookmark 50 is molded. The cut out portion can be used as a doodling stencil, as well as providing the bookmark with a decorative feature.

The clip member 54 of bookmark 50 includes opposed, outwardly flared jaws 72, 74 integrally molded to the marking strip 52 at the upper portion 66 thereof. Referring to FIG. 3, the jaws 72, 74 present a generally V-shaped writing instrument receiving channel 76. Each jaw 72, 74 includes a generally planar back plate 78 having an inner surface 80 and outer surface 82. A pair of parallel writing instrument retaining brackets 84, 86 are formed on the inner surface 80 of each back plate 78. Referring in particular to FIG. 5, it will be seen that the brackets 84, 86 supported by the back plates 78 of each jaw 72, 74 are aligned with the respective brackets 84, 86 on the back plate of the opposed jaws 72, 74.

Each of the brackets 84, 86 include opposed sidewalls 88 and an exposed bracket margin 92.

Referring in particular to FIG. 3, the jaws 72, 74, and in particular the brackets 84, 86 of the jaws 72, 74, define a lowermost neck portion 94, first and second midportions 96, 98, and an uppermost, mouth portion 100 within the clip member 54. The first and second midportions 96, 98 are formed by the upper and lower, generally concave portions 102, 104 in the bracket margins 92 of brackets 84. Mouth portion 100 is formed by the upwardly and outwardly sloped portions 106 of the bracket margins 92.

Figures 6, 7, 8, 9:
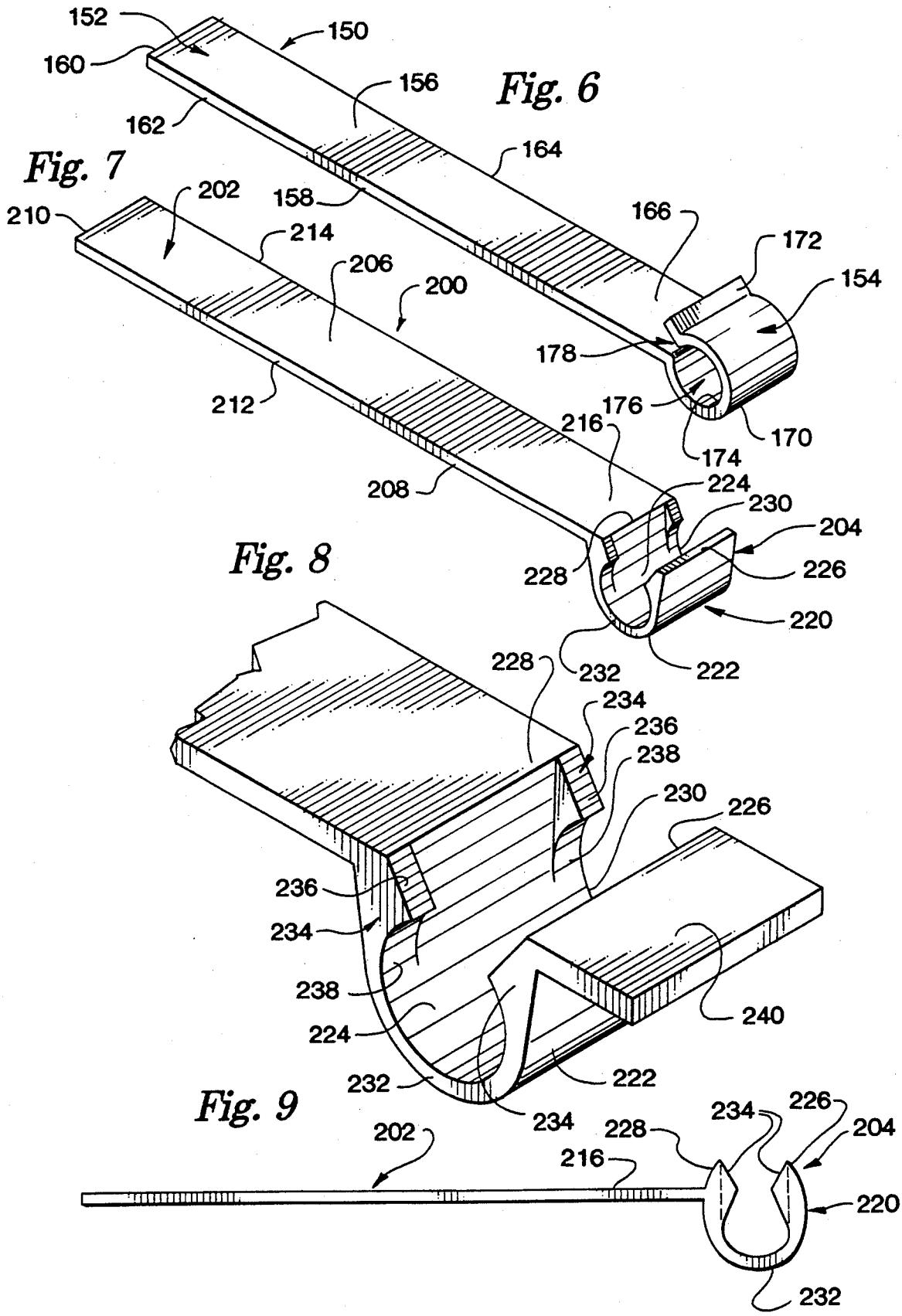
FIG. 6 is a perspective view of a third embodiment of a bookmark in accordance with the present invention.
FIG. 7 is a perspective view of a fourth embodiment of a bookmark in accordance with the present invention.
FIG. 8 is an enlarged, fragmentary view of the bookmark depicted in FIG. 7, but with a top panel extending outwardly from the leading margin of the clip member.
FIG. 9 is a side elevational view of the bookmark depicted in FIG. 7, but with the marking strip attached to the clip member along a line spaced apart from the terminal margin of the clip member.

The third embodiment of a bookmark 150 in accordance with the present invention is depicted in FIG. 6. The bookmark 150 broadly includes a marking strip 152 and a clip member 154 integrally molded with the marking strip 152. The marking strip 152 is similar in construction to the marking strip 12 described in conjunction with the first embodiment, having front and rear faces 156, 158, lower margin 160, opposed side margins 162, 164, and upper portion 166.

The clip member 154 of bookmark 150 comprises a frusto-circular in cross section loop 170 integrally attached to the upper portion 166 of marking strip 152, and a generally planar, guiding plate 172 at the terminal margin of the loop 170. The inner surface 174 of loop 170 defines a generally cylindrical, writing instrument receiving channel 176. The guide plate 172 is oriented outwardly and upwardly relative to the front face 156 of marking strip 152 so as to provide a tapered entry way 178 into the channel 176.

The fourth embodiment of a bookmark 200 in accordance with the present invention is depicted FIG. 7–9. Bookmark 200 broadly includes marking strip 202 and a clip member 204 integrally molded with the marking strip 202. The marking strip 202 is similar in construction to the marking strip 212 described in conjunction with the first embodiment, having front and rear faces 206, 208, lower margin 210, both side margins 212, 214 and upper portion 216.

The clip member 204 of bookmark 200 comprises a U-shaped in cross section receptacle 220 integrally attached to the upper portion 216 of marking strip 202.

Receptacle 220 includes convex outer surface 222 and concave inner surface 224, leading margin 226, trailing margin 228, and opposed, U-shaped margins 230, 232. Writing receptacle retaining ribs 234 extend radially inwardly from the convex inner surface 224 of clip member 220. As is readily seen from the drawings, the retaining bracket ribs 234 are respectively positioned adjacent side margins 230, 232 and the leading edge and trailing edge 226, 228 of the clip member 220. The retaining ribs 234 each present a downwardly and inwarding sloped guiding margin 236, and an annular inside margin 238 that conforms to the curvature of the clip member convex inner surface 224.

Referring to FIG. 8, will be seen that a generally planar panel 240 can be formed along the leading edge 226 of retaining clip 220. It will be appreciated by those skilled in the art that the panel 240 can be formed at a variety of angles relative to the outer surface 222 of clip member 220. Referring to FIG. 9, it will be seen that the marking strip 202 may be integrally formed to the clip member 220 along a line below the trailing edge 228 of clip member 220.

In operation, and referring to FIGS. 1 and 2, a pen P is inserted into the clip member 14 of the bookmark 10 in accordance with the first embodiment of the invention by gently inserting the pen P into the mouth portion 38 presented by jaws 30, 32. The resilient nature of the jaws 30, 32 allows the jaws 30, 32 to be spread outwardly away as the pen P is received through the mouth portion 38. As the jaws 30, 32 move outwardly away from each other, the pen P enters into the writing instrument retaining midportion 36 presented by the jaws 30, 32 and is snapably retained in place therein.

Referring to FIGS. 3–5, a writing instrument can be inserted into the writing instrument receiving channel 76 of the bookmark 50 in accordance with the second embodiment of the present invention in a manner similar to that described above in conjunction with the first embodiment of the invention. Referring to FIG. 3, writing instruments having smaller diameters can be snapably retained within the first midportion defined by the brackets 84, 86 of jaws 72, 74, and writing instruments of larger diameters can be retained within the second midportion 98 defined by the brackets 84, 86.

Referring to FIG. 6, a writing instrument can be gently urged through the writing instrument receiving channel 178 of the bookmark 150 in accordance with the third embodiment of the present invention so as to be retained within the channel 176. The resilient nature of the loop 170 allows for expansion of the loop as the pen is inserted through the channel 178 and snapable engagement of the writing instrument once it is received within channel 176.

Referring to FIG. 7–9, a writing instrument can be inserted into the clip member 220 of the bookmark 200 in accordance with the fourth embodiment of the present invention. The resilient nature of the clip member 220 allows for expansion of the clip member 220 as the pen is urged against the downwardly and inwardly sloped margins 236 of retaining ribs 234, and is snapably retained within the clip member 220 once the writing instrument is urged into the clip member 220 and against the convex inner surface 224 of the clip member 220. Referring to FIG. 8, the panel 240 can be urged downwardly with the finger of one hand as the writing instrument is inserted into the clip member 220 thereby aiding in the expansion of the clip member 220. It will also be appreciated that a design, trademark, or advertising could be imprinted on or carried by the panel 240.

We claim:

1. A combination bookmark and holder for a writing instrument comprising:

an elongated, generally planar marking strip having a lower margin and an upper portion; and retaining means for removably holding a writing instrument integrally molded with said marking strip along said upper portion, said retaining means comprised of a pair of opposed jaws comprised of a neck portion, a writing instrument engaging midportion, and a generally outwardly flared, mouth portion for guiding said writing instrument into said midportion, each jaw further comprised of a generally planar back plate including an inner surface and an outer surface, and writing instrument retaining brackets projecting inwardly from said inner surface.

2. The invention as claimed in claim 1, including a pair or writing instrument retaining brackets projecting inwardly from the inner surface of each said jaw back plate, the retaining brackets of each respective back plate being aligned with the retaining brackets of the opposed back plate.

3. The invention as claimed in claim 2, said retaining brackets presenting said writing instrument engaging midportion with first and second midportions, said first midportion oriented below said second midportion, and said second midportion being oriented adjacent said mouth portion, said second midportion having a larger width than said first midportion.

4. A combination bookmark and holder for a writing instrument comprising:

an elongated, generally planar marking strip having a lower margin and an upper portion; and retaining means for removably holding a writing instrument integrally molded with said marking strip along said upper portion, said retaining means including a mouth portion for snapably receiving said writing instrument, a generally U-shaped in cross section neck portion operably, flexibly coupling said mouth portion to said marking strip and a generally U-shaped in cross section clip member having an outer surface and an inner surface and writing instrument engaging retaining ribs extending radially inwardly from said inner surface.

5. A combination bookmark and holder for writing instrument comprising:

an elongated, generally planar marking strip having a lower margin and an upper portion; and retaining means for removably holding a writing instrument integrally molded with said marking strip along said upper portion, said retaining means comprising a generally U-shaped in cross section clip member having an outer surface and an inner surface and writing instrument engaging retaining brackets extending radially inwardly from said inner surface.

* * * * *

UNITED STATES PATENT AND TRADEMARK OFFICE

CERTIFICATE OF CORRECTION

PATENT NO. : 5,016,559

DATED : May 21, 1991

INVENTOR(S) : Vada J. Larson, Roger L. Larson, Walter I. Bieger

It is certified that error appears in the above-identified patent and that said Letters Patent is hereby corrected as shown below:

On the title page of the patent in the section naming the inventors, in line 3, delete "Mich." and substitute therefor --Minn.--.

On the title page of the patent in the section naming the assignees, in line 2, delete "Mich." and substitute therefor --Minn.--.

In Column 4, line 64, delete "or" and substitute therefor --of--.

Signed and Sealed this

Twenty-second Day of September, 1992

*Attest:*

DOUGLAS B. COMER

*Attesting Officer*

*Acting Commissioner of Patents and Trademarks*